US005216321A

United States Patent [19]

Kawamura et al.

[11] Patent Number: 5,216,321

[45] Date of Patent: Jun. 1, 1993

[54] SHADOW-MASK TYPE COLOR CATHODE-RAY TUBE

[75] Inventors: Takao Kawamura, Chiba; Masaharu Kumada, Mobara; Hideo Tanabe, Mobara; Masaki Shinoda, Mobara, all of Japan

[73] Assignee: Hitachi, Ltd., Tokyo, Japan

[21] Appl. No.: 441,965

[22] Filed: Nov. 28, 1989

[30] Foreign Application Priority Data

Nov. 30, 1988 [JP] Japan ..... 63-300494

[51] Int. Cl.[5] ..... H01J 29/07; H01J 29/86

[52] U.S. Cl. ..... 313/479; 313/408; 313/477 R

[58] Field of Search ..... 313/408, 479, 478, 477 R

[56] References Cited

U.S. PATENT DOCUMENTS 3,777,204 12/1973 Robbins et al. ..... 313/403
4,631,439 12/1986 D'Amato et al. ..... 313/477 R
4,779,025 10/1988 Paynton et al. ..... 313/478
4,806,583 2/1989 Battaglia ..... 313/478 X
4,884,006 11/1989 Prazak ..... 313/478 X
4,893,054 1/1990 Kobayashi ..... 313/408

FOREIGN PATENT DOCUMENTS 63-942 3/1987 Japan .

*Primary Examiner*—Sandra L. O'Shea
*Attorney, Agent, or Firm*—Antonelli, Terry, Stout & Kraus

[57] ABSTRACT

Disclosed is a shadow-mask type color cathode-ray tube comprising a faceplate having a curved inner surface which prevents degrouping and a substantially flat outer surface. In this color cathode-ray tube, the resolution is not deteriorated in the peripheral portion and an inespensive flat material is usable as a glass plate provided with a reflection reducing coating or a touch panel attached to the outer surface of the faceplate. Since a shadow mask supported with a tension applied thereto is usable, the positional deviation of the apertures due to the expansion of the shadow mask during operation is prevented.

16 Claims, 1 Drawing Sheet

SHADOW-MASK TYPE COLOR CATHODE-RAY TUBE

BACKGROUND OF THE INVENTION

The present invention relates to a shadow-mask type color cathode-ray tube which is suitable for a color television tube, a color display tube for data processor, etc., especially, having a high resolution.

In the case of a shadow-mask type color cathode-ray tube in which the inner surface of the faceplate is flat and the shadow mask is also flat, the relative intervals between the electron beams which have reached the inner surface of the faceplate through the shadow mask apertures or slits are not constant, which causes what is called degrouping in the peripheral portion of the shadow mask. To reduce an error caused by degrouping, a method of making the pitch of the electron beam passing apertures larger in the peripheral portion of the shadow mask than in the central part thereof has been proposed, as described in Japanese Patent Laid-Open No. 942/1988. However, if the pitch of the shadow mask apertures is larger in the peripheral portion of the shadow mask than in the central portion thereof, defects such as deterioration of the resolution are produced. An error caused by degrouping is conventionally reduced by so designing the faceplate as to have a curved inner surface. In the prior art, in the case of the faceplate having a curved inner surface, the outer surface also has a curved surface so that the glass of the faceplate has a substantially uniform thickness.

On the other hand, a shadow mask which is set in the state of being stretched by tension, as described in Japanese Patent Laid-Open No. 942/1988, cannot generally have any other shape than a flat shape. In the case of a shadow mask having slit-type electron beam passing apertures, the shadow mask may have a cylindrical surface with the axis parallel to the slits.

If the faceplate has a flat outer surface, it is economically advantageous, because it is possible to use a flat glass plate as glass with a reflection reducing coating which is pasted to the outer surface of the faceplate and a flat touch panel is also usable.

However, no shadow-mask type color cathode-ray tube which has a faceplate with a flat outer surface and has a good characteristic as a cathode-ray tube has been known yet.

SUMMARY OF THE INVENTION

Accordingly, it is an object of the present invention to eliminate the above-described problems in the prior art such as the deterioration of the resolution in the peripheral portion caused by making the pitch of the electron beam passing aperture larger in the peripheral portion of a shadow mask having a flat or a cylindrical surface than in the central part thereof and to provide a shadow-mask type color cathode-ray tube having a faceplate with a flat outer surface while keeping the advantages thereof.

To achieve this aim, the present invention provides a shadow-mask type cathode-ray tube comprising a shadow mask with electron beam passing apertures provided at a substantially uniform pitch over the entire surface thereof; and a faceplate with a substantially flat outer surface and a curved inner surface having a curvature which is substantially exclusively determined so as to prevent degrouping in consideration of the deflected magnetic field characteristic and the deflection angle of an electron beam determined by the structural dimension of an electron gun and the magnetic field characteristic of a deflection yoke, and from the conditions that the pitch of the apertures is substantially uniform and that the pitch of the positions on the inner surface of the faceplate which the electron beams for the respective colors reach through the apertures is uniform.

The shadow-mask type color cathode-ray tube having the above-described structure can solve the problem such as the deterioration of the resolution in the peripheral portion conventionally caused by making the pitch of the electron beam passing aperture larger in the peripheral portion of a shadow mask having a flat or cylindrical surface than in the central part thereof. It is also possible to produce a shadow-mask type color cathode-ray tube having a faceplate with a flat outer surface while keeping the advantages thereof.

According to the present invention, it is possible to solve the problems such as the deterioration of the resolution in the peripheral portion caused by making the pitch of the electron beam passing aperture larger in the peripheral portion of a shadow mask having a flat or cylindrical surface than in the central part thereof and to produce a shadow-mask type color cathode-ray tube having a faceplate with a flat outer surface while keeping the advantages thereof. In addition, if a shadow mask having a flat or cylindrical surface is provided with a tension for tension-support thereof to the mask-frame, since the self-shape preservability is unnecessary, a shadow mask having a thin thickness, and small electron beam passing apertures at a small pitch and, hence, suitable for a display tube for high resolution, can be easily put to practical use.

If the shadow mask is supported with a tension within the elastic limit applied thereto at room temperature, even if the temperature rises during operation due to the collision of electron beams and the shadow mask is expanded, only the tension within the elastic limit lowers without producing substantially any positional deviation of the apertures.

The above and other objects, features and advantages of the present invention will become clear from the following description of the preferred embodiments thereof, taken in conjunction with the accompanying drawings.

DESCRIPTION OF THE PREFERRED EMBODIMENTS

First Embodiment

Figure 1:
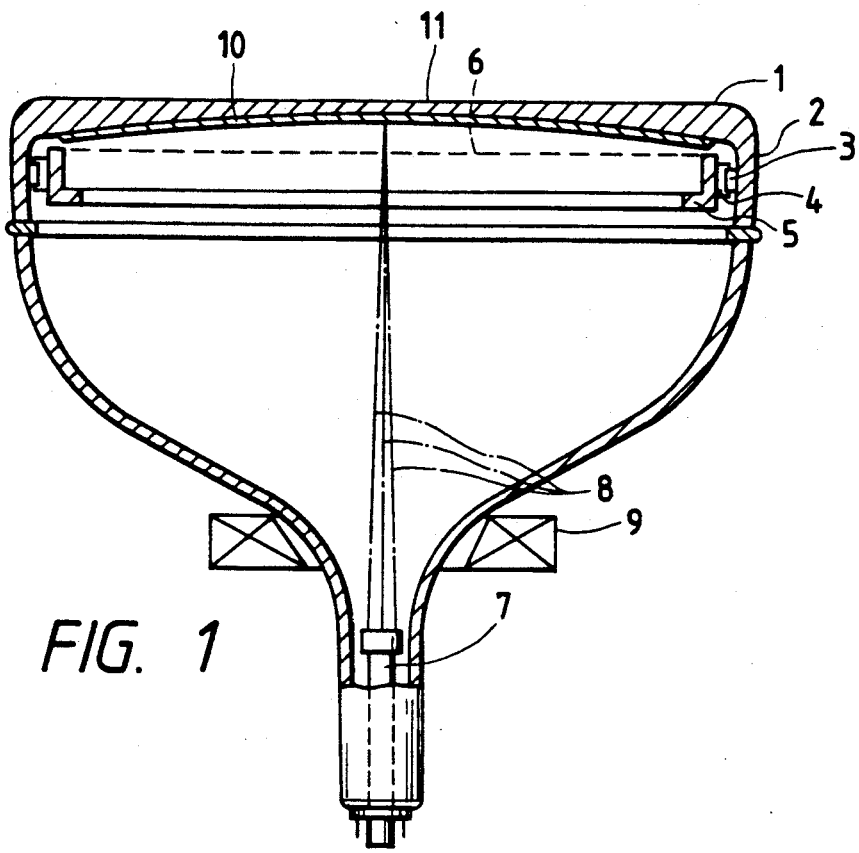
FIG. 1 is a side elevational view of a color cathode-ray tube in an embodiment according to the present invention with the main part thereof in section.

FIG. 1 is a side elevational view of a color cathode-ray tube in an embodiment according to the present invention with the main part thereof in section. On the inner surface of a panel 1, a color phosphor screen 10 is formed, and a pin 3 is disposed in the skirt portion 2 of the panel 1. A frame 5 over which a shadow mask 6 is tension-supported in the form of a flat plate is suspended from the pin 3 through a spring 4. Apertures of 0:08 mm in diameter are formed over the entire surface of the shadow mask at a pitch of 0.2 mm. The apertures are so arranged that the lines connecting the centers of the adjacent apertures cross each other at an angle of 60° and the interval between the adjacent apertures is uniformly regular over the entire surface.

Three electron beams 8 which are emitted from an electron gun 7 such that the interval between the adjacent electron beams is 5.5 mm at the point of emission and they are converged at the center of the inner surface of a face plate 11 of the panel 1 are deflected by a deflection coil 9 over the entire surface of the color phosphor screen 10. At this time, the magnetic field of the deflection coil 9 (self-convergence coil) is adjusted or the relative interval between the adjacent electron beams is adjusted to be larger by an appropriate amount before deflection so that the three electron beams are converged at the point of incidence over the entire surface of the color phosphor screen 10. Due to such adjustment, if both the shadow mask 6 and the inner surface of the faceplate 11, namely, the color phosphor screen 10 have flat surfaces, the relative intervals between the adjacent electron beams which have reached the color phosphor screen 10 through the shadow mask 6 become larger in the peripheral portion than in the central portion, so that it is impossible to make the intervals of the points of incidence of the electron beams 8 uniform over the entire surface.

In order to make all the intervals of the points of incidence uniform, it is necessary to reduce the interval between the shadow mask 6 and the inner surface of the faceplate 11, namely, the color phosphor screen 10 in proportion to the distance from the center. In other words, it is necessary to so design the faceplate 11 as to provide the inner surface with a predetermined curvature. The curvature is substantially exclusively determined from (i) the condition that the pitch of the round apertures of the shadow mask 6 is substantially uniform over the entire surface of the shadow mask 6, (ii) the deflection angle of the electron beam determined by the dimension of the electron gun 7 and the magnetic field characteristic of the deflection yoke, (iii) the deflected magnetic field characteristic and (iv) the condition that the relative intervals between the adjacent electron beams which have reached the inner surface of the faceplate 11, namely, the color phosphor screen 10 through the apertures of the shadow mask 6 are uniform. For example, when the pitch of the apertures of the shadow mask 6 was 0.2 mm, the deflection angle of the electron beam was 90°, the relative interval between the points of emission of the adjacent electron beams was 5.5 mm, the shortest relative interval between the points of incidence of the adjacent electron beams (the length of the segments of the lines which connect the centers of the points and cross each other at an angle of 60°) was 0.12 mm, and a self-convergence coil was used, the curvature radius of the spherical inner surface of the faceplate 11 was about 20 m when the color phosphor screen 10 had a diagonal diameter of 300 mm, and the curvature radius was about 30 m when the color phosphor screen 10 had a diagonal diameter of 450 mm.

The curvature radius or the shape of the curved surface of a color phosphor screen is generally finally determined by cut-and-try so as to prevent degrouping, and this process was also adopted in this embodiment.

In a conventional color cathode-ray tube, in which the pitch of the electron beam passing apertures and the pitch of the points at which the electron beams reaches the phosphor screen are larger in the peripheral portion than in the central portion and both the inner surface and the outer surface of the faceplate are flat, the pitch of the electron beam points in the peripheral portions of the phosphor screen was 25% larger as compared with that in this embodiment, and the resolution was deteriorated with the increase in the pitch.

In the color cathode-ray tube of this embodiment, since the outer surface of the faceplate 11 is flat, the thickness of the faceplate 11 is naturally larger in the peripheral portion than in the central portion.

Second Embodiment

Figure 2:
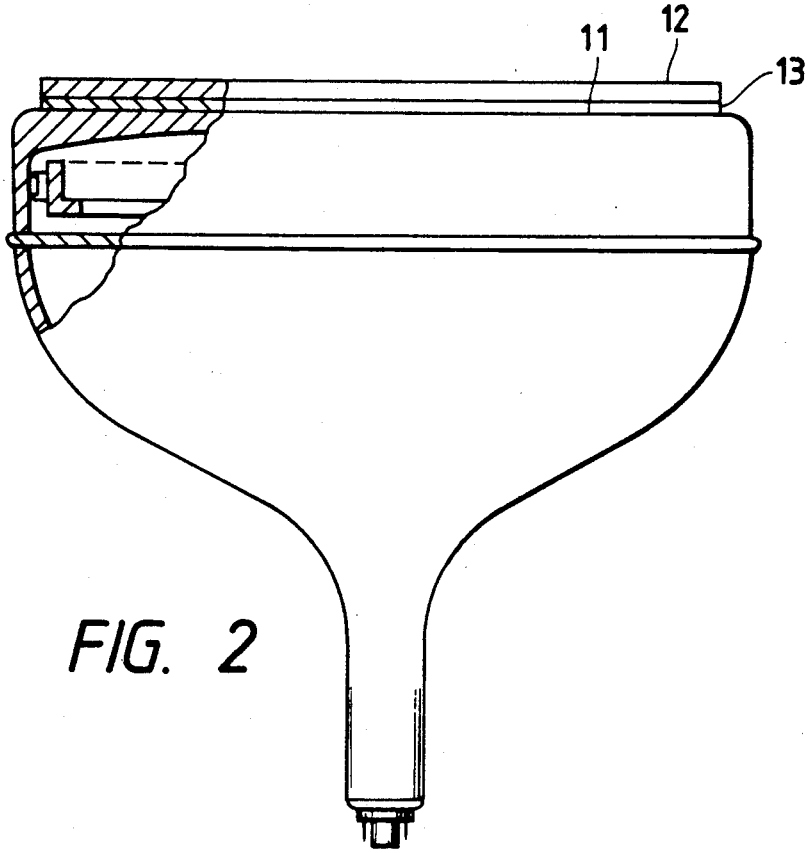
FIG. 2 is a partially sectional side elevational view of a color cathode-ray tube in another embodiment according to the present invention.

Since a shadow-mask type color cathode-ray tube of the present invention has the faceplate 11 with a flat outer surface, in the case of pasting, for example, a glass plate 12, provided with a reflection reducing coating on the surface, to the outer surface of the faceplate 11 by an adhesive 13, as shown in FIG. 2, a flat plate is economically advantageously usable as the glass plate 12. The same effect is also obtained in the case of attaching a touch panel to the outer surface of the faceplate 11 in place of the glass plate 12.

In this embodiment, a good effect was obtained when the glass plate 12 provided with a reflection reducing coating was pasted to the outer surface of the faceplate 11 of the color cathode-ray tube obtained in the first embodiment by the adhesive 13, as shown in FIG. 2.

In these embodiments, a shadow mask provided with round apertures and an electron gun of in-line type are used, but it goes without saying that the same effect is also obtained by using a shadow mask provided with slits, a faceplate having a cylindrical surface or an electron gun of delta type.

A shadow-mask type color cathode-ray tube according to the present invention has a faceplate having a curved inner surface of a curvature in accordance with the present invention, which prevents the resolution from being deteriorated in the peripheral portion In addition, since the outer surface of the faceplate is flat, in the case of pasting a glass plate provided with a reflection reducing coating or attaching a touch panel to the outer surface of the faceplate, such a member is sufficed with an inexpensive flat material. It is also possible to use a flat shadow mask which is provided with electron beam passing apertures at a regular pitch and which is stretched by a tension over a mask frame for a shadow-mask type color cathode-ray tube of the present invention, so that a shadow mask having a thin thickness, and small electron beam passing apertures at a small pitch and, hence, suitable for a display tube for high resolution, can be easily put to practical use.

While there has been described what are at present considered to be preferred embodiments of the invention, it will be understood that various modifications may be made thereto, and it is intended that the appended claims cover all such modifications as fall within the true spirit and scope of the invention.

What is claimed is:

1. A shadow-mask type color cathode-ray tube comprising a faceplate having a curved inner surface and a substantially flat outer surface wherein said shadow mask is flat and has electron beam passing apertures arranged with a substantially uniform pitch over the entire surface of said shadow mask.

2. A shadow-mask type color cathode-ray tube according to claim 1, wherein said shadow mask is supported by tension.

3. A shadow-mask type color cathode-ray tube according to claim 2, wherein said electron beam passing apertures are round apertures or slit apertures.

4. A shadow-mask type color cathode-ray tube according to claim 1, wherein a glass plate provided with a reflection reducing coating is attached to said outer surface of said faceplate.

5. A shadow-mask type color cathode-ray tube according to claim 1, wherein a flat touch panel is attached to said outer surface of said faceplate.

6. A shadow-mask type color cathode-ray tube according to claim 1, wherein said curved inner surface of said faceplate is substantially spherical or cylindrical.

7. A shadow-mask type color cathode-ray tube comprising: a faceplate with a substantially flat outer surface and a curved inner surface having a curvature which is substantially exclusively determined in consideration of the deflection angle of an electron beam determined by the structural dimension of an electron gun and the magnetic field characteristic of a deflection yoke, and from the conditions that the pitch of electron beam passing apertures is substantially uniform over the entire surface of said shadow mask which is flat and that the pitch of the positions on said inner surface of said faceplate which the electron beams for the respective colors reach through said apertures is uniform.

8. A shadow-mask type color cathode-ray tube according to claim 7, wherein the curved inner surface of the face plate is substantially spherical or substantially cylindrical, the shadow mask is supported by tension, and the electron beam passing apertures having the substantially uniform pitch over the entire surface of the shadow mask are round or slit apertures.

9. A shadow-mask type color cathode-ray tube according to claim 8, wherein a glass plate provided with a reflection reducing coating is attached to the outer surface of the face plate.

10. A shadow-mask type color cathode-ray tube according to claim 8, wherein a flat touch panel is attached to the outer surface of the face plate.

11. A shadow-mask type color cathode-ray tube comprising a face plate having a substantially spherical or cylindrical inner surface and a substantially flat outer surface, and a flat shadow mask with a pitch of round or slit apertures for passing an electron beam through the shadow mask being substantially uniform over the entire surface of the shadow mask.

12. A shadow-mask type color cathode-ray tube according to claim 11, wherein the shadow mask is supported by tension.

13. A shadow-mask type color cathode-ray tube according to claim 11, wherein a glass plate provided with a reflection reducing coating is attached to the outer surface of the face plate.

14. A shadow-mask type color cathode-ray tube according to claim 11, wherein a flat touch panel is attached to the outer surface of the face plate.

15. A shadow-mask type color cathode-ray tube according to claim 11, wherein a pitch of positions on the inner surface of the face plate which the electron beams for the respective colors reach through the apertures is uniform.

16. A shadow-mask type color cathode-ray tube comprising a faceplate having a curved inner surface, wherein said shadow-mask is flat and has electron beam passing apertures arranged with a substantially uniform pitch over the entire surface of said shadow mask.

* * * * *